United States Patent [19]

Barry

[11] 4,158,271

[45] Jun. 19, 1979

[54] DOOR CLOSURE

[75] Inventor: John Barry, Westwood, Mass.

[73] Assignee: William S. Hawkes, Magnolia, Mass.

[21] Appl. No.: 871,438

[22] Filed: Jan. 23, 1978

[51] Int. Cl.[2] ..... E05F 1/10

[52] U.S. Cl. ..... 49/386; 16/75

[58] Field of Search ..... 49/386; 16/75, 141, 16/143

[56] References Cited

U.S. PATENT DOCUMENTS

| | | | |
|---|---|---|---|
| 1,140,129 | 5/1915 | Diener | 16/141 |
| 3,307,734 | 3/1967 | Campbell | 16/75 X |

FOREIGN PATENT DOCUMENTS

| | | | |
|---|---|---|---|
| 2320832 | 4/1973 | Fed. Rep. of Germany | 16/75 |
| 346144 | 4/1931 | United Kingdom | 16/75 |
| 678208 | 8/1952 | United Kingdom | 16/75 |

*Primary Examiner*—Kenneth Downey
*Attorney, Agent, or Firm*—Arthur Z. Bookstein

[57] ABSTRACT

A self-closing door device includes a torsion bar which is connected at its ends between the hinged side of the door and the door jamb. The torsion bar is arranged to twist about as well as bend along its longitudinal axis and in a manner which tends to decelerate the door as the door approaches its closed position.

6 Claims, 7 Drawing Figures

DOOR CLOSURE

BACKGROUND AND SUMMARY OF THE INVENTION

This invention relates to spring door closures and particularly to an improved door closure arrangement which employs a torsion bar to bias the door toward its closed position. A variety of devices have been proposed and used to automatically close doors. Typically, these devices may require special hinges or spring devices. Many display an annoying tendency to slam the door shut and, in some instances, it is preferred to provide a supplemental damping device in combination with the door closing device in order to preclude slamming. In most instances, these devices usually require a number of mechanical parts, are somewhat costly, have a tendency to ultimately malfunction because of wear or the like and require some periodic maintenance.

The present invention relates to a door closure which uses a torsion bar which is directly attachable to the door without supplemental hardware. The device utilizes only one part which is the torsion bar itself. One end of the bar is inserted into a hole formed in the door jamb and the other end of the bar is inserted into a hole formed in the door. The bar is installed so that it is straight when the door is open but is bowed when the door is closed. As the door advances from its open toward its closed configuration, the bowing of the bar increases to present a light, but steadily increasing force which tends to resist the progressively decreasing force of the torsion spring. The bowing of the bar thus progressively resists closure of the door to effect a self-damping action which decelerates the door as it approaches its fully closed configuration. The hinges may be provided with a means by which the door may be retained in an opened position, should that be desired.

While the use of torsion bars has been suggested in the prior art for a door closure device, none of those torsion bars include any self-contained means for damping the closure force. Typically, all require special fittings and hardware to attach the torsion bar to the door. In most instances, the torsion bar is not concealed and is somewhat unsightly.

It is among the general objects of the invention to provide an improved door closure device.

A further object of the invention is to provide a torsion bar for closing a door in which the bar provides a self-damping means which tends to decelerate the door as it approaches its closed configuration.

Another object of the invention is to provide a door closure device of the type described which is inexpensive to manufacture and easy to install.

A further object of the invention is to provide a torsion bar door closure device which requires no supplemental mechanical parts and is of one-piece construction.

Another object of the invention is to provide a door closure device of the type described which is substantially wear-free and free of mechanical difficulties.

A further object of the invention is to provide a door closure device in which the torsion bar is substantially concealed.

DESCRIPTION OF THE DRAWINGS

The foregoing and other objects and advantages of the invention will be appreciated more fully from the following further description thereof, with reference to the accompanying drawings wherein.

DESCRIPTION OF THE PREFERRED EMBODIMENT

The invention is illustrated as being used in connection with a cabinet, for example, of the type which may ordinarily be found in kitchens or the like. It should be noted, however, that although the invention is suited particularly for use with kitchen cabinets, it may be used with other doors and is not limited to use with such cabinets.

Figure 1:
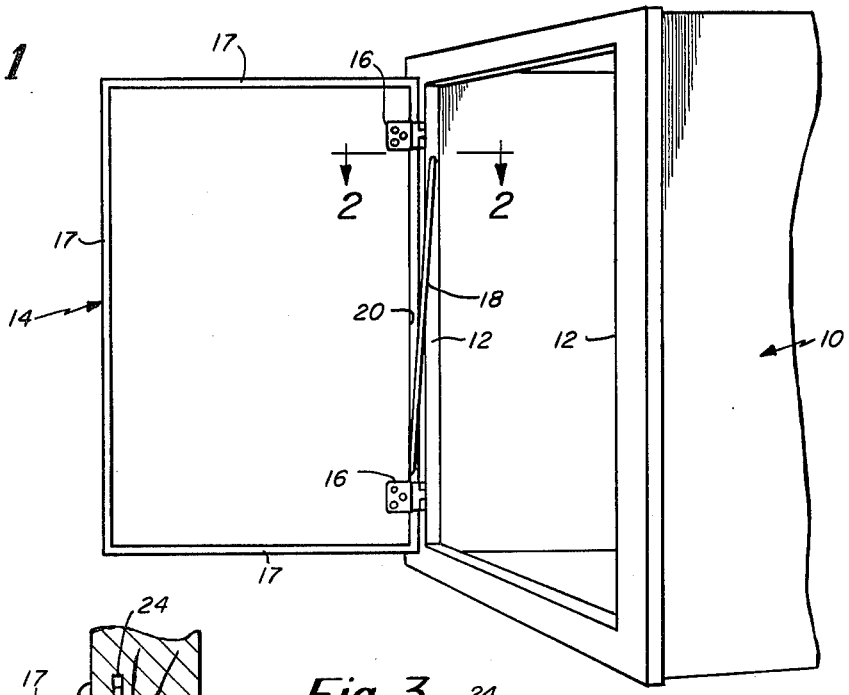
FIG. 1 is an illustration of the device as used with a cabinet, with the door in an open configuration.

As shown in FIG. 1, the cabinet 10 includes jambs 12. The door 14 may be attached, by conventional hinges 16 to the outward face of one of the jambs 12. In the embodiment shown, the cabinet door 14 is provided with a peripheral flange 17 which overlaps the front facing surface of the door opening. The cabinet is provided with a torsion bar 18 which is connected at its upper end to the laterally facing surface of one of the jambs 12 and at its other end to the edge 20 of the door 14. As described below, the torsion bar 18 is installed in a pre-loaded configuration and in a manner such that when the door is opened, as suggested in FIGS. 1 and 2, the bar 18 will extend in a straight line between its connections between the jamb 12 and the inner edge 20 of the door.

Figure 5:
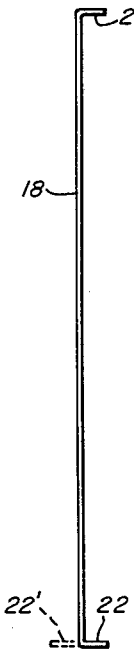
FIG. 5 is an illustration of the torsion bar before installation.

FIG. 5 shows the torsion bar 18 which may be formed from steel wire. The diameter and length of the bar may be selected to provide the desired forces, dependent on the size and mass of the door 14. By way of example, with a conventional kitchen cabinet door, weighing about 8 pounds and having dimensions of the order of 14 inches wide and 22 inches high, the bar may be approximately 12 inches long and 0.042 inches diameter. The torsion bar 18 is bent at its ends as indicated at 22 in FIG. 5. It should be noted that the configuration shown in FIG. 5 in solid illustrates the bar 18 when in a relaxed, unloaded configuration. Also, it should be noted that although the ends 22 of the bar 18 are shown as being bent approximately at right angles to the main body of the bar, it is not essential that the ends 22 extend at right angles and may be disposed at any other angle which will be sufficient to hold the bar in place.

Figure 2:
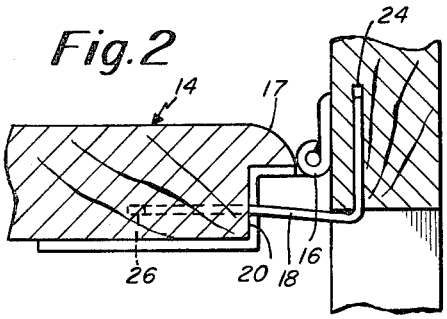
FIG. 2 is a sectional view of the device as seen along the line 2—2 of FIG. 1.
Figure 3:
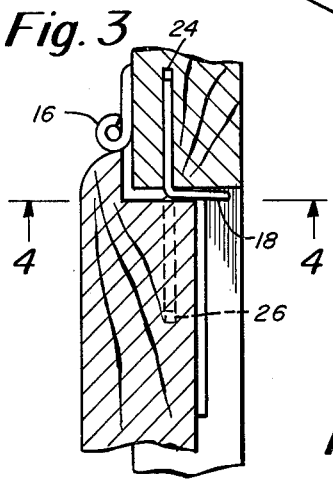
FIG. 3 is an illustration similar to FIG. 2 showing the door and torsion bar when the door is fully closed.

The bar is installed by simply drilling a hole 24 near or in the edge of the jamb 12 and a hole 26 near or in the edge 20 of the door 14. The holes are drilled so that they will receive the bent ends 22 of the bar 18. The holes 24, 26 are located so that when the door is open as shown in FIG. 1, the main portion of the bar 18 will extend in a straight line. The ends 22 of the bar 18 are twisted (for example, as suggested in phantom at 22' in FIG. 5) so that the bar may be installed in a configuration in which it is pre-loaded when the door is in a closed position (FIG. 3). The pre-loading should be in a manner in which further torsion will be applied to the bar 18 as the door is opened. As illustrated in FIG. 3, the bar is pre-loaded by twisting the end 180°. When the door is opened as shown in FIG. 2, the bar will have been twisted to an angle of the order of 270°. From the foregoing, it will be appreciated that when the door is released from its open position (FIG. 2), the torsion in the bar 18 will tend to swing the door to a closed position.

Figure 4:
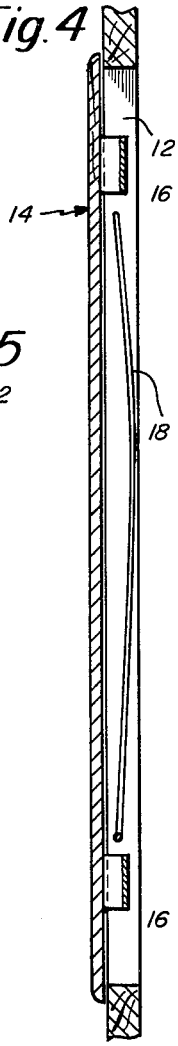
FIG. 4 is an illustration of the device as seen along the line 4—4 and showing the bowed configuration of the torsion bar when the door is fully closed.

As described, when the door is in an open position, the straight-line distance between the holes 24, 26 is less than the straight line distance between those holes when the door is in a closed configuration. Thus, when the door swings toward its closed position, that will necessarily cause the bar 18 to begin to bow from its straight configuration. The bar 18 is illustrated in its bowed configuration when the door is closed, in FIGS. 3 and 4, from which it will be understood that the bow of the bar 18 generates a force tending to open the door, in opposition to the torsion force in the bar 18 which tends to close the door 14. Thus, as the door swings from its open toward its closed position, the bowing force of the bar 18 increases progressively while the torsion force of the bar decreases. These forces oppose each other which has a damping effect on the speed with which the door closes and tends to decelerate the door as it approaches its closed configuration. That reduces the normal tendency of the door to slam shut.

It should be noted that the torsion bar 18 is installed without any supplemental hardware and that the only part is the one-piece element consisting of the bar 18 itself. The device is free of the numerous mechanical parts which typify prior spring closure and damping systems. There is no need for a separate latch to retain the door shut because the torsion bar may be selected so that its torsion force will slightly exceed the bowing force when the door is closed to maintain the door in a closed configuration but under a very light force. Alternatively, a magnetic or other type of catch may be provided to secure the door shut, in which case, the torsion bar 18 may be selected so that the bowing force just equals the torsion force when the door is closed. In addition, the hinge 16 may be provided with a detent which will tend to hold the door 14 open when the door has been opened past a predetermined limit.

Figure 6:
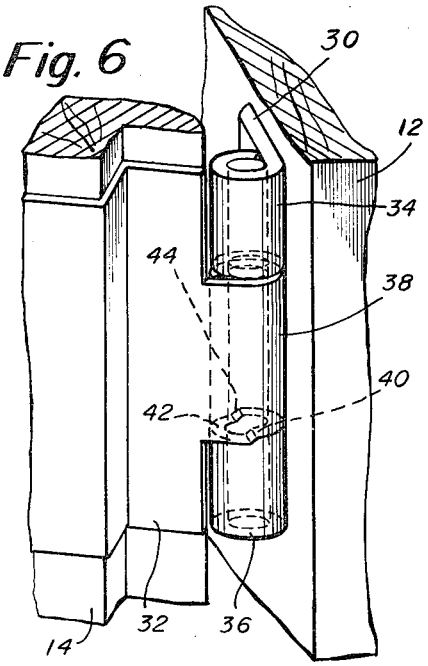
FIG. 6 is an illustration of a modified form of the invention using a hinge which will retain the door in an open position, the illustration showing the hinge in its open position.
Figure 7:
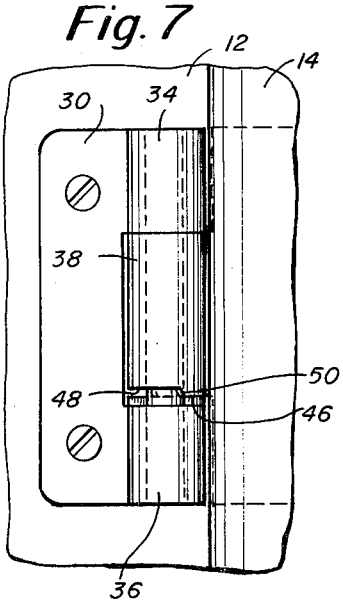
FIG. 7 is an illustration of the hinge shown in FIG. 6 as seen from the front of the cabinet, with the door closed.

In some instances, it may be desirable to provide a means to retain the door 14 in an open position, until such time as the door is intentionally released. For example, this may be desirable with kitchen cabinets, as when they are being loaded with dishes or the like and it would be somewhat inconvenient to have to open the door repeatedly. To this end, FIGS. 6 and 7 show a hinge construction having retaining means to hold the door in an open position when the door has been opened beyond a predetermined position, for example beyond 90° and, preferably, when the door is opened between 100° to 115°. As shown, the hinge includes a fixed hinge member 30 which is secured to the cabinet and a movable hinge member 32 which is secured to the movable door. In the embodiment illustrated, the fixed hinge 30 includes a pair of spaced gudgeons, including an upper gudgeon 34 and a lower gudgeon 36. The movable hinge 32 includes a movable gudgeon 38 which fits between the spaced gudgeons 34, 36 of the fixed hinge member 30. The upwardly facing surface of the lower gudgeon 36 is formed to define a raised arcuate segment 40 and a lowered shoulder segment 42, the segments 40, 42 being joined by sloped surfaces indicated at 44. The downwardly facing surface of the gudgeon 38 is formed to define complementary surfaces indicated at 46, 48 in FIG. 7, and joined by beveled surfaces 50. The surfaces 40, 42, 44 of the lower fixed gudgeon 36 and surfaces 46, 48, 50 of the movable gudgeon 38 are arranged so that when the door is closed, the extended surface 46 of the movable gudgeon 38 will rest on the extended bearing surface 40 of the lower gudgeon 36. The door is free to swing with those surfaces in engagement with each other, under the influence of the spring 18.

The cooperating surfaces of the gudgeons 36, 38 are arranged so that when the door is opened beyond a predetermined magnitude, preferably between 100° and 115°, the downwardly projecting surface of the movable gudgeon 38 will advance into the shoulder defined by the surface 42 on the bottom gudgeon thereby to lock the hinge and the door in that open position. Closing of the door from that position requires a slight manual movement of the door to raise the door and its gudgeons 38 so that its surfaces 46 bear on the bearing surface 40 of the bottom gudgeon. Once the door has been so raised (by a small angular movement of the door), the door then is free to close under the influence of the spring 18, as described above. From the foregoing, it will be appreciated that the hinges are constructed to permit a limited amount of vertical movement between the door and the cabinet, when the door and its fixed gudgeons 38 are in their lowermost, locked position.

It should be understood that the foregoing description of the invention is intended merely to be illustrative thereof and that other embodiments and modifications of the invention may be apparent to those skilled in the art without departing from its spirit.

Having thus described the invention, what I desire to claim and secure by Letters Patent is:

1. A closure device for a door which is hingedly mounted to a door jamb comprising:

a torsion bar connected at one end at a first location to the door jamb and at its other end, at a second location, to an adjacent portion of the door;

the distance between said first and second locations, when the door is closed, being less than the length of the torsion bar whereby said bar will be attached in a manner such that when the door is open the bar will extend along a straight line from said first to said second locations, whereby when the door swings toward its closed position, the bar will bow in a direction which will generate a force tending to bias the door toward an open position;

the bar being installed in a pre-loaded torsion condition which will tend to maintain the door in its closed position when the door is closed, said torsional force of the bar and force from the bowing of the bar being directed opposite each other whereby as the door approaches its closed configuration, the progressive bowing of the bar will progressively tend to decelerate the door.

2. An arrangement as defined in claim 1 wherein the torsion bar comprises an elongate bar having its opposite ends being bent;

each of the door jamb and hinged edge of the door being provided with holes receptive to one of the bent ends of the bar, said bent ends and holes comprising the sole means of attachment for the bar.

3. An arrangement as defined in claim 1 wherein the bar is preloaded and attached at locations in which, when the door is closed, the torsional force will slightly exceed the force generated by the bowing of the spring.

4. An arrangement as defined in claim 1 wherein the torsional force of the spring, when the door is closed, equals the bowing force exerted by the spring, and further comprising supplemental latch means for securing the door in its closed position.

5. A closure device as defined in claim 1 further comprising:

hinge means constructed and arranged to enable unrestrained swinging movement of the door between its closed position and to an open position of up to 90° arc, said hinge means being constructed to lock the door from movement in a closing direction in response to opening of the door beyond 90°.

6. A device as defined in claim 5 wherein said hinge means comprises:

a fixed hinge attached to the jamb and including a pair of vertically spaced gudgeons;

a movable hinge secured to the door and including a movable gudgeon, the movable gudgeon being disposed between the fixed gudgeons;

the downwardly facing surface of the movable gudgeon and the upwardly facing surface of the lowermost gudgeon being constructed to define a detent engageable when the door has been opened beyond 90°, said detent being constructed to resist the closure force of the spring, thereby to maintain the door in an open configuration.

* * * * *